US005400965A

United States Patent [19]

Ratnik et al.

[11] Patent Number: 5,400,965

[45] Date of Patent: Mar. 28, 1995

[54] AUTOMATED SNOW-MAKING SYSTEM

[75] Inventors: H. Ronald Ratnik, Pittsford; Larry Carter, Hemlock, both of N.Y.

[73] Assignee: Ratnik Industries, Inc., Victor, N.Y.

[21] Appl. No.: 891,693

[22] Filed: Jun. 1, 1992

[51] Int. Cl.[6] ..... F25C 3/04

[52] U.S. Cl. ..... 239/2.2; 239/14.2

[58] Field of Search ..... 239/14.2, 2.2; 335/205–207

[56] References Cited

U.S. PATENT DOCUMENTS

| | | | |
|---|---|---|---|
| 4,292,615 | 9/1981 | Ohashi | 335/205 |
| 4,545,529 | 10/1985 | Tropeano et al. | 239/14.2 X |
| 4,597,524 | 7/1986 | Albertsson | 239/14.2 |
| 4,836,446 | 6/1989 | Chanel | 239/14.2 X |
| 5,102,043 | 4/1992 | Inoue et al. | 239/14.2 X |

FOREIGN PATENT DOCUMENTS

| | | | |
|---|---|---|---|
| 1128328 | 10/1979 | Canada | 239/14.2 |
| 2064826 | 6/1981 | United Kingdom | 239/156 |

*Primary Examiner*—Andres Kashnikow

*Assistant Examiner*—Kevin P. Weldon

*Attorney, Agent, or Firm*—Warren W. Kurz

[57] ABSTRACT

Each snow-gun site of a multisite snow-making system is equipped with a microprocessor-based logic and control unit. The latter responds to time-varying signals representative of the ambient temperature and relative humidity of its associated site to continuously adjust the flow rate of water applied to the snow gun(s) of such site in order to maintain a desired snow consistency. Based on the instantaneous values of temperature and relative humidity, the logic and control unit determines a nominal water flow rate value which, for the particular parameters of the snow-making system, will produce a desired snow consistency. This nominal value is compared with the present water flow rate value to produce a control signal used for adjusting a motor-controlled valve which determines the water flow rate applied to the snow-gun. The nominal water flow rate value can be selectively adjusted, on site, to account, for example, for gradual changes in system parameters, e.g., water temperature, compressed air pressure, etc., which will affect the snow consistency.

10 Claims, 6 Drawing Sheets

NOZZLE WATER PRESSURE IN PSIG

| DRY BULB TEMP. (DEG.F) | 0-10% RH | 11-30% RH | 31-55% RH | 56-80% RH | 81-100% RH |
|---|---|---|---|---|---|
| 31-33 | 43 | 37 | 20 | 8 | 7 |
| 28-30 | 60 | 47 | 34 | 21 | 9 |
| 25-27 | 72 | 62 | 47 | 36 | 30 |
| 22-24 | 90 | 76 | 68 | 50 | 36 |
| 19-21 | 104 | 91 | 79 | 69 | 51 |
| 16-18 | 126 | 114 | 101 | 91 | 68 |
| 13-15 | 161 | 135 | 124 | 114 | 86 |
| 10-12 | 202 | 183 | 170 | 126 | 102 |
| 7-9 | 217 | 196 | 176 | 135 | 125 |
| 4-6 | 288 | 231 | 208 | 152 | 131 |
| 1-3 (& BELOW) | 340 | 288 | 224 | 183 | 161 |

FIG. 5

AUTOMATED SNOW-MAKING SYSTEM

BACKGROUND OF THE INVENTION

The present invention relates to the art of making snow for ski resorts and the like. More particularly, it relates to further improvements in automation of the snow-making process.

Though the art of snow-making has been practiced for several decades, it is still a labor-intensive process to produce a large quantity of "quality" snow at a desired location on a mountain side. While it is now a relatively simple matter to combine compressed air and water in a "snow-gun" to produce, under controlled conditions, a uniform blanket of snow having a desired moisture content, it is considerably more difficult to produce such a blanket of snow on a ski trail atop a mountain where the terrain is highly irregular, and the temperature, relative humidity and wind undergo frequent, unpredictable and severe changes of the type that dramatically affect snow quality and placement. It is not uncommon, for example, to discover in the morning following a night of snow-making that, as a result of an unexpected change in humidity, temperature and/or wind speed or direction, most of the snow made has either been deposited into the adjacent woods, or has become so laden with moisture as to become unsuitable for skiing.

To cope with the ever-changing weather conditions, many ski resorts maintain large crews of equipment operators whose primary function is to make weather-related adjustments to the snow-guns. For example, the guns should always be aimed in a direction to take wind direction and speed into account. Moreover, the compressed air-to-water ratio should always be maintained at a level which accounts for both ambient temperature and relative humidity; otherwise the snow consistency will be either too wet or too dry. Only a few degrees temperature change, or a few percent change in relative humidity, will have a dramatic effect on the snow-making efficiency and quality of the snow produced.

In the commonly assigned U.S. Pat. No. 5,031,832 issued in the names of H. R. Ratnik et al., there is disclosed a snow-making system in which the tasks of aiming the snow-gun and adjusting the air-to-water ratio are performed remotely. Motor-controlled valves are used to adjust air and water flow to the guns, and motor-controlled mounts are used to adjust both azimuth and elevation of the snow spray. While this automated system allows adjustments to be made from afar, there is still a need for an operator to make frequent visits to each snow gun site to adjust for changes in temperature and/or humidity.

While it is known in the art to use a centrally located computer to adjust the air-to-water ratio at each of a plurality of snow-gun sites based on temperature and relative humidity samplings at each site, such centrally-controlled systems tend to be disadvantageous from the standpoints of cost, complexity and maintenance. For example, in the case of a computer failure, snow-making over the entire ski resort is affected. Moreover, there is no easy way to override a nominal air-to-water setting to compensate for changes in system parameters, such as variations in water temperature, compressed air pressure, water purity, etc. In such case, an equipment operator located at an affected snow-gun site must communicate with the central control station, identifying the site of interest and ordering changes, for example, in water flow rate to cure the problem observed. Achieving the desired flow rate through an intermediary is not a trivial task. Moreover, as indicated above, any maintenance or servicing of the computer system also has the effect of shutting down the entire snow-making operation.

SUMMARY OF THE INVENTION

In view of the foregoing discussion, an object of this invention is to provide an automated snow-making system in which the above-noted deficiencies are overcome.

The snow-making system of the invention basically comprises (a) temperature and relative humidity sensors for respectively producing first and second signals representative of the ambient temperature and relative humidity in the vicinity of a snow-gun site; (b) water flow rate-determining means for producing a third signal representative of the actual flow rate of the pressurized water being applied to the snow gun; (c) logic and control means operatively coupled to the temperature and relative humidity sensors for receiving the first and second signals and determining, from the combination thereof, a nominal flow rate of water which should be applied to the snow-gun to achieve a desired snow quality; (d) means for comparing values representing the actual and nominal water flow rates to provide a control signal representative of the difference between such values; (e) means for incrementally adjusting the nominal flow rate value to selectively adjust the control signal; and (f) means responsive to the control signal for adjusting the rate of water flow to the snow-gun. Preferably, the logic and control means comprises a look-up table in which combinations of the first and second signal values are correlated with a water flow rate value required to produce a desired compressed air/water ratio at the snow gun. Preferably, the adjusting means is controllable from the snow-making site, and includes a magnetic field-actuated switch which is wholly contained within a weather-proof housing.

The invention will be better understood from the ensuing detailed description of a preferred embodiment, reference being made to the accompanying drawings.

BRIEF DESCRIPTION OF THE DRAWINGS

FIG. 5 is a table relating temperature, relative humidity and water pressure.

DETAILED DESCRIPTION OF A PREFERRED EMBODIMENT

Figure 1:
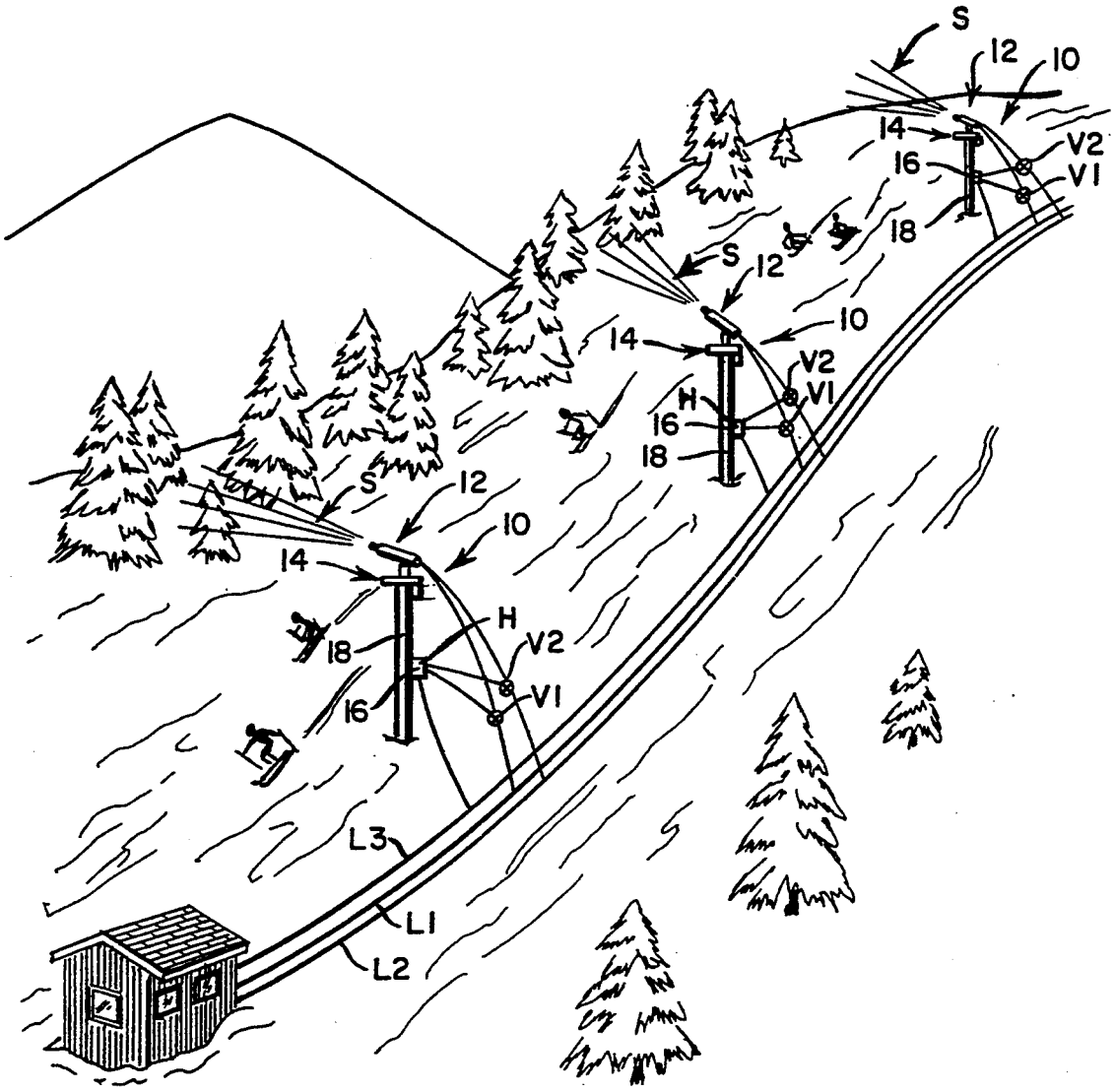
FIG. 1 is a schematic illustration of a multisite snow-making system of the type in which the invention is useful.

Referring now to the drawings, FIG. 1 illustrates a snow-making system comprising a plurality of snow-making sites 10 arranged at various locations along the ski trails of a ski resort. Each snow-making site comprises one or more snow-guns 12, each gun being mounted on a motor-controlled mount 14. Each snow gun may, for example, be of the type disclosed in the commonly assigned U.S. Pat. No. 3,829,013, issued to H. R. Ratnik. Such a gun operates, in a well known manner, to provide a spray of ice crystals (snow) upon combining water and compressed air under certain conditions which need not be explained here. It suffices to say that the consistency or "quality" of the snow produced by these devices is dependent, in large part, on the atmospheric conditions at the site, and the relative proportions of air and water supplied to each device. Water under high pressure and compressed air are supplied to each gun by water and compressed air lines L1 and L2, respectively. Electrical power is provided to each site via a power line L3. Motor-controlled valves V1 and V2 control the flow of water and air supplied to the guns through line L1 and L2.

Figure 2:
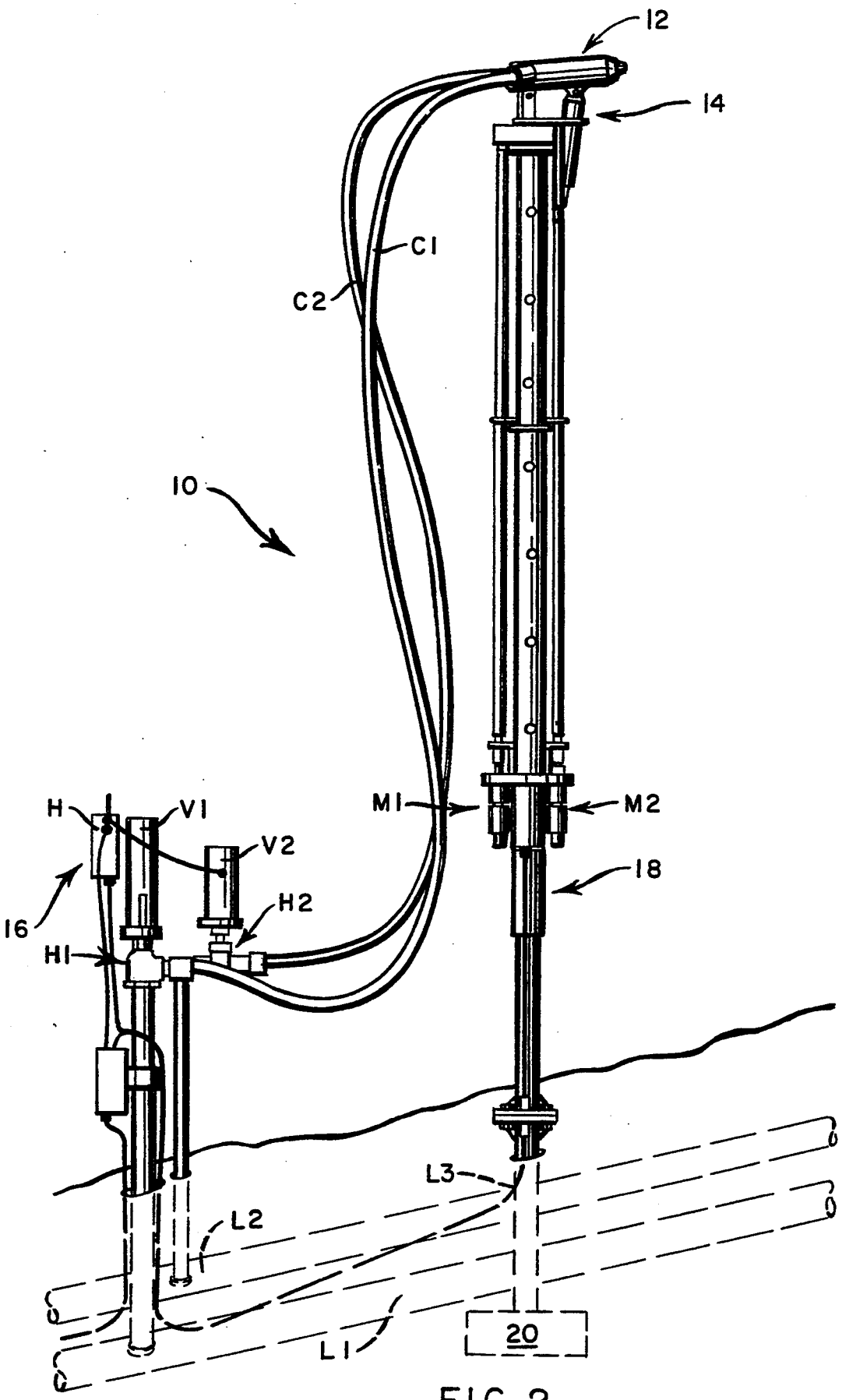
FIG. 2 is a side elevation of a snow-making site of the FIG. 1 system.

In accordance with the present invention, the operation of at least the water line valve V1 is controlled by a microprocessor-based logic and control unit (LCU) 16 associated with each snow-making site. Each LCU is mounted within a protective, weatherproof housing H which, as shown in FIG. 1, can be mounted on a tower 18 which supports the snow-gun or, as shown in FIG. 2, on a water or air hydrant H1 and H2, respectively, discussed below in connection with FIG. 2. As explained below, the output of each LCU can be controlled, in part, by an operator who is in a position to personally sample the quality of the snow produced by the snow-gun.

Referring to FIG. 2 which better illustrates the mechanical details of each snow-making site, each snow-gun 12 is supported by a motor-controlled mount 14 atop a telescoping tower 18 extending upwardly from a concrete base 20 buried beneath ground level. The azimuth and elevation of the snow-gun are controlled by motors M1 and M2, respectively. The mechanical details and operation of the snow gun mount are disclosed in detail in the aforementioned U.S. Pat. No. 5,031,832, the disclosure of which is incorporated herein by reference. Water is supplied to the snow gun via a conduit C1 which interconnects the snow-gun with water hydrant H1. Similarly, compressed air is supplied to the snow-gun via conduit C2 which interconnects the snow-gun and air hydrant H2. Each hydrant comprises a motor-controlled valve (V1 and V2) which responds to a control signal provided by the LCU to regulate the flow of fluid therethrough.

Figure 4:
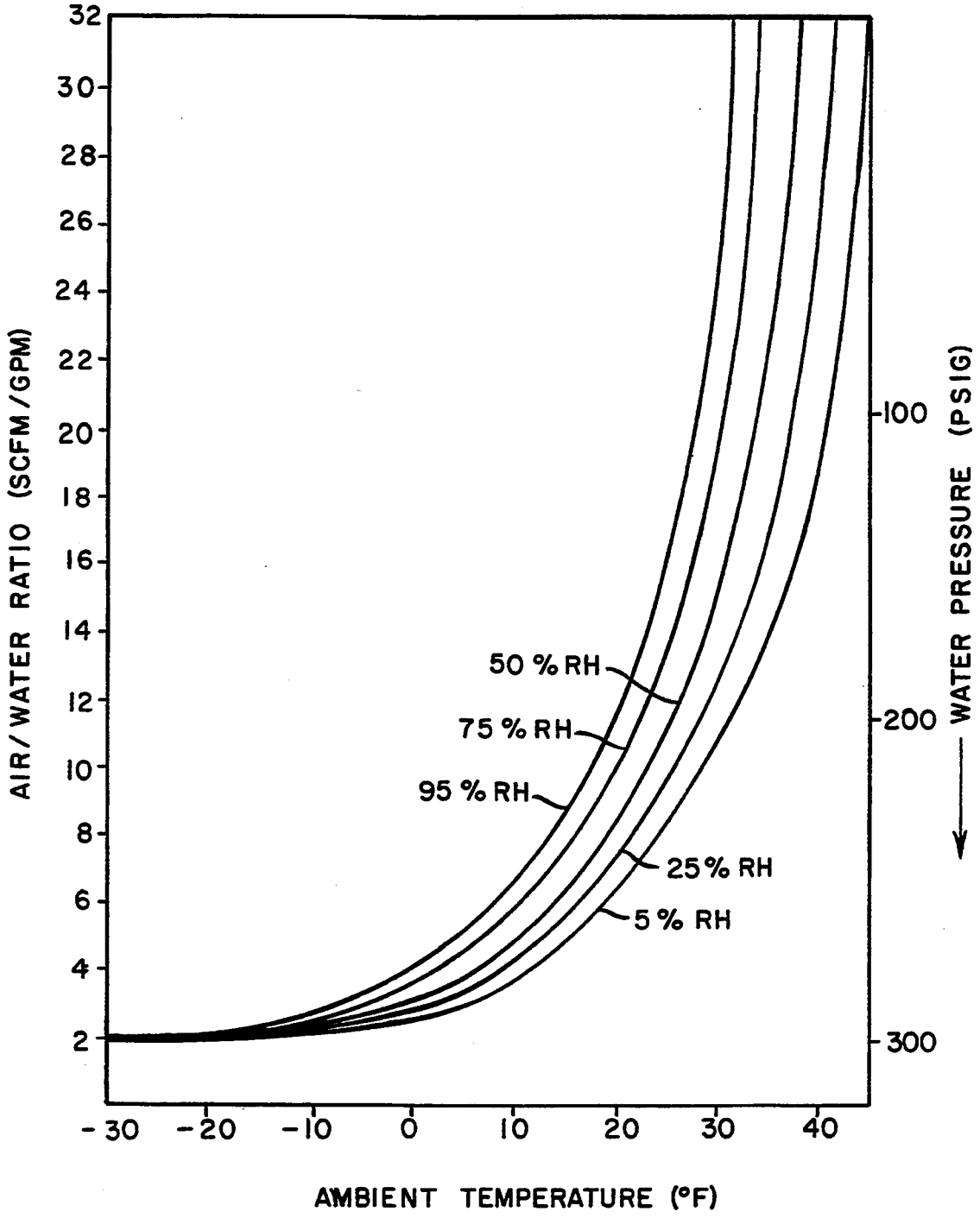
FIG. 4 is a series of curves relating temperature, relative humidity and air/water ratio.

As noted above, the quality of snow produced by snow-gun 12 is largely dependent on the ambient temperature and relative humidity at the snow-making site. As either or both of these parameters vary with time, it is necessary to adjust the compressed air/water ratio applied to the gun in order to maintain a desired or "nominal" snow quality. A typical relationship between temperature, humidity and air/water ratio is illustrated in the graphs of FIG. 4. In reading these graphs it will be noted that there is a nominal air/water ratio for each combination of temperature and relative humidity. As either temperature or relative humidity change, the nominal air/water ratio will change. It is important to note that these curves are based on certain other assumed "system parameters" which also affect snow quality. Some of these system parameters are fixed, such as the characteristics of the snow gun and pipelines, and once taken into account in plotting the curves, need not be considered again. Other system parameters, such as water temperature, compressed air pressure, water purity, etc. will vary over the course of a snow-making season and must be taken into account in using the curves of FIG. 4. As explained below, the apparatus of the invention enables the effect of these other system parameters to be taken into account.

Figure 3:
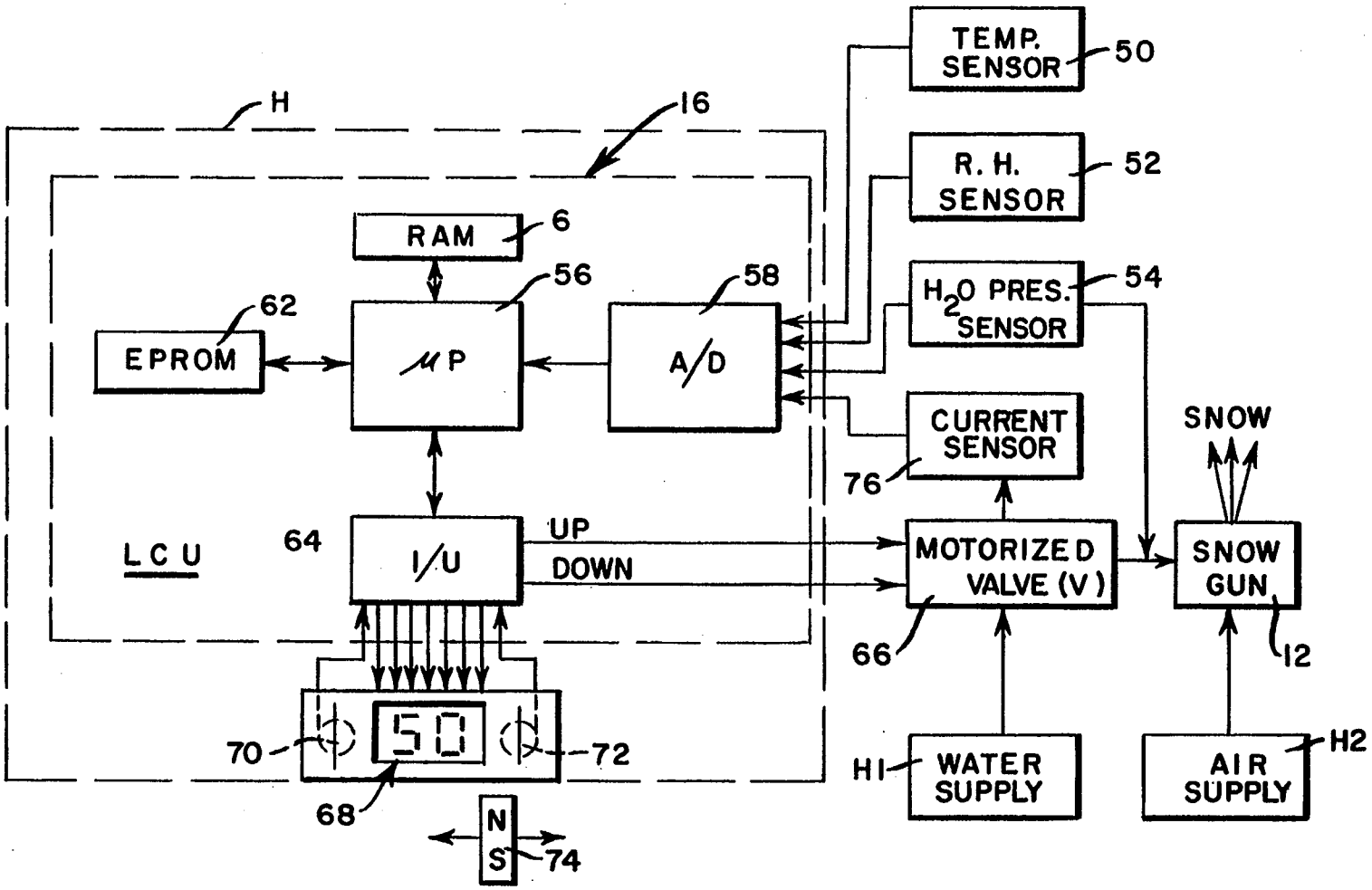
FIG. 3 is a functional block diagram of certain components comprising each snow-making site of the FIG. 1 system.

To obviate the need for an operator to be on hand at all times to monitor snow quality and make the appropriate adjustments to the air/water ratio, means are provided, in accordance with this invention, for making these adjustments automatically at each snow-making site. Referring to FIG. 3, such automatic adjustment means includes a temperature sensor 50 for producing a first signal proportional to the ambient temperature at an associated site, a relative humidity sensor 52 for producing a second signal proportional to the ambient relative humidity at such site, and a water pressure sensor 54 for producing a third signal proportional to the instantaneous flow rate of water being applied to the snow gun of that site. These signals are input to a conventional microprocessor 56 of LCU 16 via an analog-to-digital (A/D) converter 58. The microprocessor may be, for example, the Model Z-80 made by Zilog Corporation. The A/D converter may be, for example, the ADC-0808 made by National Semiconductor Corporation. The LCU includes a random access memory (RAM) 60 which is programmed to carry out the process described herein, and in particular the process defined by the flow chart of FIG. 6, described below. An electrically programmable read-only memory (EPROM) 62 is programmed to store a look-up table (LUT) which includes the information of FIG. 4 in table form. A typical table of the type stored in the EPROM is shown in FIG. 5. LCU 16 also comprises an input/output device (I/O) 64 which, for example, outputs control signals to a motorized valve 66 which controls the flow rate of water from water hydrant H1 to the snow-gun and, hence, the air/water ratio and the resulting snow quality. Note, while it is preferred to adjust the water flow rate to control the air/water ratio at the snow-gun, it will be appreciated that the air flow rate could also be controlled. But experience has shown that a finer adjustment of snow quality can be effected by controlling only the water flow rate while allowing the air pressure to be constant.

In addition to providing control signals to valve 66, the LCU controls a pair of 7-segment LED displays 68 to display a digital value (e.g. the number "50") representing the nominal air/water ratio presently being supplied to the snow-gun-gun. At opposite sides of the pair of digital displays is a pair of magnetic reed switches 70,72 which, when subjected to a changing magnetic field, produce a signal pulse, either positive or negative-going. The LCU responds to this signal pulse to incrementally adjust the nominal water pressure (or flow rate) acted upon by the LCU in producing an appropriate valve control signal. The requisite changing magnetic field is produced by simply swiping a bar magnet 74 across the surface of the reed switch. In response to each signal pulse, the LCU increases or decreases the value of the control signal so as to produce, for example, a 1% change in the pressure of water applied to the snow-gun. For each swipe of the bar magnet across one switch or the other, the LCU also increases or decreases by one the number displayed on the digital display. As noted above, the LCU is contained in a weather-proof housing, preferably made of fiber-glass or other non-magnetic material. The digital display is located on one surface of such housing, and the magnetic reed switches are wholly contained within such housing, in close proximity to the display-supporting surface so as to be influenced by the movement of the bar magnet. Having no parts external to the housing, the magnetic reed switch is particularly preferred as a means for inputting an offset signal to the output signal applied to the motorized valve.

Figure 6:
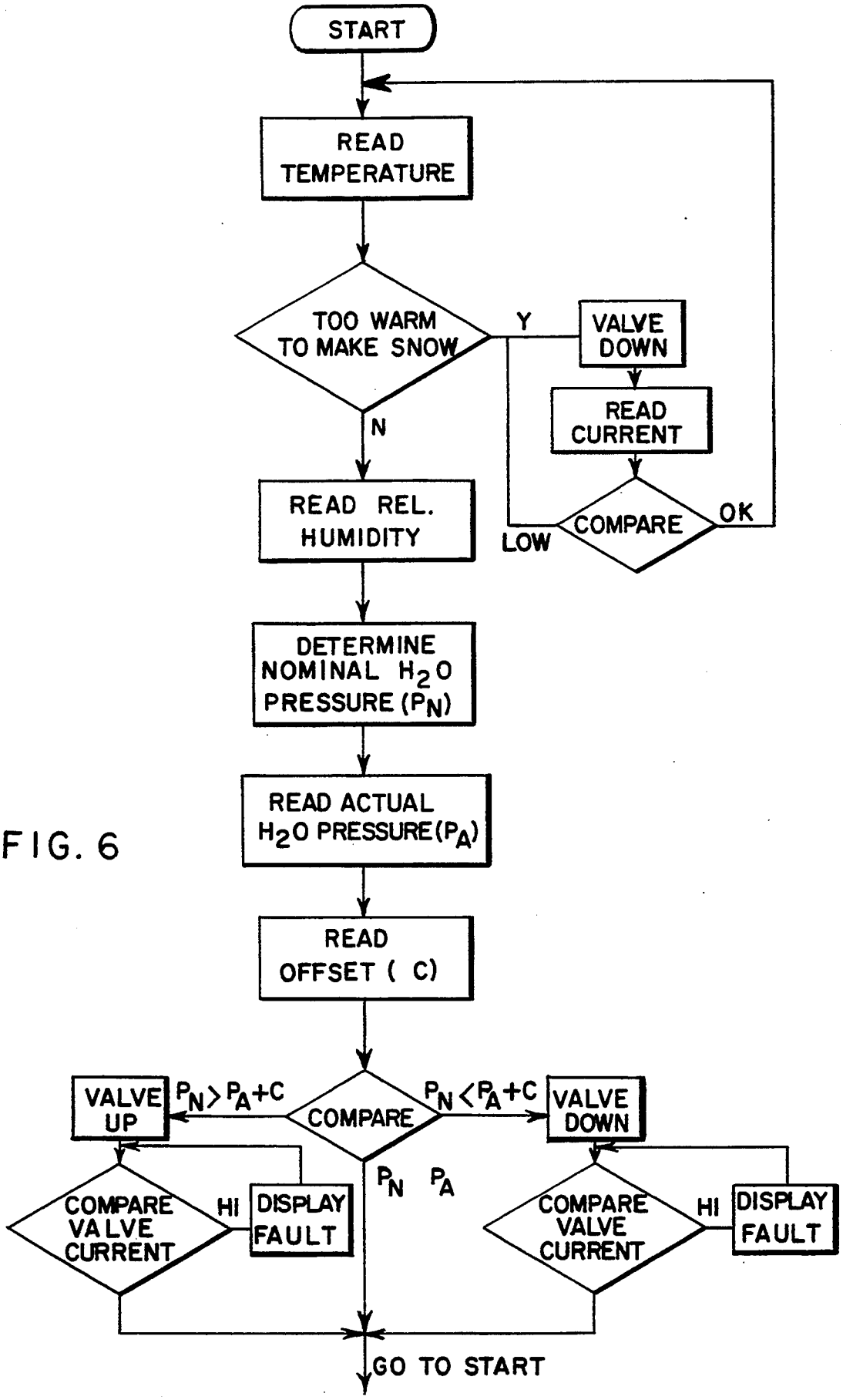
FIG. 6 is a flow chart illustrating various steps performed by the microprocessor-based logic and control unit of FIG. 3.

Referring now to FIG. 6, the first step carried out by LCU 16 in automatically adjusting the air/water ratio to compensate for temperature and humidity changes is to read the ambient temperature, as represented by the output signal produced by sensor 50. If the read temperature exceeds a predetermined level (say 32 degrees Fahrenheit) at which snow can not be efficiently made, a valve "down" (i.e., close) signal will be applied to the water hydrant to shut-off the water supply to the snow-gun. A current sensor 76 senses the current applied to the water valve and provides an input to the LCU. When the current exceeds a predetermine threshold, indicating that the valve is closed, the process is repeated. If the ambient temperature is acceptable for snow-making, the ambient relative humidity is read from sensor 52. From the combination of temperature and relative humidity readings, the nominal water pressure required to produce a nominal air/water ratio is determined from the look-up table in the EPROM. (Note, since it is easier to detect water pressure than flow rate, water pressure is sensed in conduit C1 and its value is easily correlated with flow rate. The actual water pressure is read from sensor 54, and the amount of offset C introduced by the operator through the magnetic reed switches is determined. The LCU then compares the nominal pressure with actual pressure plus the offset. If these values are equal, no change is produced in the control signal applied to the water valve. If one exceeds the other, then the valve is either opened or closed to produce equilibrium. During valving "up" and "down", the valve motor current is sensed to detect proper operation.

From the foregoing, it will be appreciated that the automated snow-making system of the invention affords certain advantages over the aforementioned prior art system. Of particular significance is the fact that the nominal water flow rate programmed into the EPROM is easily offset to compensate for gradually changing system parameters. If the operator notices that the snow produced has increased in water content to an undesired level, the operator can incrementally change the snow quality by appropriately operating the magnetic reed switches a desired number of times. The change in the valve "up"/"down" signal will remain in effect until power is shut off. By taking note of the digital display 68 at one site, the operator can use this information in making adjustments, if desired, at other sites. By having a logic and control unit at each site, servicing of one site has no effect on the others, and the snow-making efficiency can be readily maximized for each site.

The invention has been described with reference to a preferred embodiment. It is apparent that modifications can be made without departing from the spirit of the invention, and such are intended to fall within the scope of the appended claims.

What is claimed is:

1. An automated snow-making system comprising a plurality of snow-making sites, each site comprising a snow-gun which operates to produce a spray of man-made snow by mixing compressed air and pressurized water applied thereto, such spray of man-made snow having a moisture content determined, in part, by (i) the ratio of compressed air and pressurized water applied to the snow-gun, and (ii) the ambient temperature and relative humidity in the vicinity of the snow-gun, each of said sites further comprising:

(a) a temperature sensor for producing a first signal representative of said ambient temperature;

(b) a relative humidity sensor for producing a second signal representative of said ambient relative humidity;

(c) means for producing a third signal representative of the actual instantaneous flow rate of water applied to the snow gun;

(d) logic and control means operatively coupled to said temperature and relative humidity sensors for receiving said first and second signals and for determining, from the combination thereof, a nominal water flow rate value to be applied to its associated snow-gun, said nominal flow rate value being related to different combinations of ambient temperature and relative humidity by a predetermined relationship, said logic and control means comprising means for comparing said actual flow rate value with said nominal flow rate value to produce a control signal representative of the difference between said actual and nominal values;

(e) means responsive to said control signal for adjusting the flow rate of water applied to said snow-gun; and (f) magnetic field-responsive means for incrementally adjusting said nominal flow rate value to selectively adjust the flow rate of water to said snow-gun.

2. The system as defined by claim 1 wherein said logic and control means comprises a look-up table in which combinations of values represented by said first and second signals are correlated with a nominal water flow rate values required for its associated snow-gun to produce a desired compressed air/pressurized water ratio.

3. The system as defined by claim 2 wherein the signals produced by said temperature and relative humidity sensors are periodically sampled by said logic and control unit.

4. The system as defined by claim 1 wherein said logic and control unit operates to shut-off the supply of pressurized water to said snow-gun in the event the ambient temperature, as represented by said first signal, is greater than a predetermined value.

5. The system as defined by claim 1 wherein said adjusting means comprises a magnetic field-actuated switch which, when subjected to a changing magnetic field, is adapted to produce a signal pulse, said logic and control unit being responsive to each signal pulse produced by said switch to incrementally change said nominal flow rate value by a predetermined amount.

6. The system as defined by claim 5 wherein said switch is mounted within a housing containing said logic and control unit.

7. An automated snow-making process in which a spray of man-made snow is produced by mixing compressed air with pressurized water, such spray of man-made snow having a moisture content determined, in part, by (i) the ratio of compressed air and pressurized water applied to the snow-gun, and (ii) the ambient temperature and relative humidity in the vicinity of the snow-gun, said process comprising the steps of:

(a) producing a first signal representative of said ambient temperature;

(b) shutting off the supply of pressurized water to the snow-gun in the event the ambient temperature, as represented by said first signal, is greater than a predetermined value;

(c) producing a second signal representative of said ambient relative humidity;

(d) producing a third signal representative of the present flow rate of water applied to the snow gun;

(e) determining, from a predetermined relationship correlating combinations of ambient temperature and relative humidity values with different values of water pressure, a nominal water flow rate value for the present values of ambient temperature and relative humidity;

(f) comparing said nominal flow rate value with a value representing the present water flow rate to produce a control signal representative of the difference between the nominal and present flow rate values; and (g) adjusting the water flow rate applied to the snow-gun in response to said control signal.

8. The process as defined by claim 7 wherein said determining step comprises extracting said nominal flow rate value from a look-up table in which combinations of first and second signal values are correlated with nominal water flow rate values required to produce a desired compressed air/pressurized water ratio at the snow-gun.

9. The process as defined by claim 7 wherein the signals representative of ambient temperature and relative humidity sensors are periodically sampled.

10. The process as defined by claim 7 further comprising the step of selectively adjusting the nominal water flow rate value to account for variations in the compressed air/water ratio not caused by temperature and relative humidity changes.

* * * * *